US006798433B1

(12) United States Patent
Sun et al.

(10) Patent No.: US 6,798,433 B1
(45) Date of Patent: Sep. 28, 2004

(54) METHOD FOR INCREASING THERMAL PRINT QUALITY

(75) Inventors: Ming-Jyh Sun, Taipei Hsien (TW); Hong-Shun Chiou, Taipei Hsien (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/605,272

(22) Filed: Sep. 18, 2003

(30) Foreign Application Priority Data

Jul. 30, 2003 (TW) ..... 92120905 A

(51) Int. Cl.[7] ..... B41J 2/355

(52) U.S. Cl. ..... 347/211; 400/120.07; 400/120.01; 347/183

(58) Field of Search ..... 400/120.01, 120.07, 400/120.08; 347/183, 185, 211

(56) References Cited

U.S. PATENT DOCUMENTS 4,704,617 A * 11/1987 Sato et al. ..... 347/182
4,933,686 A * 6/1990 Izumi et al. ..... 347/171
2003/0043232 A1 * 3/2003 Fang et al. ..... 347/43

* cited by examiner

*Primary Examiner*—Leslie J. Evanisko
(74) *Attorney, Agent, or Firm*—Winston Hsu

(57) ABSTRACT

A printing method for printing a pixel at a gray level x on paper by a printer. The printer includes a thermal print head, which includes a heater for heating a ribbon to print pixels from gray levels 1 to m−1 on the paper, and the ribbon. The method includes: if x is not greater than a value n, heating the ribbon x times and evenly distributing the heating initiation times of the x times between the time point 0 and the time point (m*(x−1)/n) for printing the pixel at gray level x on the paper. If x is greater than the value n, heating the ribbon x times and evenly distributing the heating initiation time of the n times between the time point 0 and the time point (m*(n−1)/n) and distributing the heating initiation times of the x−n times after the heating initiation time points of the n times.

7 Claims, 7 Drawing Sheets

METHOD FOR INCREASING THERMAL PRINT QUALITY

BACKGROUND OF INVENTION

1. Field of the Invention

The present invention relates to a printing method for increasing thermal printer quality, and more specifically, to a printing method for increasing thermal printer quality when printing a pixel at a gray level x on paper by a printer.

2. Description of the Prior Art

Photo printers are different from general printers. The major difference is that photo printers print images such as a photo pictures on paper with high picture quality. Please refer to FIG. 1 and FIG. 2. FIG. 1 is a diagram of a prior art photo printer 10. FIG. 2 is a simplified exploded view of the photo printer 10 shown in FIG. 1. As shown in FIG. 1, the photo printer 10 has a ribbon 14, a thermal print head 12, a ribbon driver 18, and a roller set 20. The ribbon 14 has a plurality of sections, and each section is used for storing a different colored dye. The thermal print head 12 is fixed inside the photo printer 10 for heating the color dyes so that the color dyes are transferred onto a photo paper 16. The ribbon driver 18 is used for moving the ribbon 14 back and forth so that the thermal print head 12 can transfer a specific colored dye stored on the ribbon 14 onto the corresponding photo paper 16. The roller set 20 is used for holding the photo paper 16 and moving the photo paper 16 along a predetermined direction. Therefore, the fixed thermal print head 12 is capable of printing a color image on the photo paper 16.

As shown in FIG. 2, the thermal print head 12 has a plurality of heaters 22 that are arranged linearly and spaced equally for heating the ribbon 14. The colored dye stored on the ribbon 14 is heated, and is transferred onto the photo paper 16. When the thermal print head 12 starts printing images, each heater 22 positioned on the thermal print head 12 heats the ribbon 14 so that a plurality of corresponding pixels X1 will form a line image Y1. The photo paper 16 driven by the roller set 20 is then moved along the predetermined direction at a predetermined speed. Another line image Y2 is then printed on the same photo paper 16 next to the line image Y1. Accordingly, a plurality of line images are printed on the same photo paper 16 to complete the printing operation.

As mentioned above, the total number of heaters 22 positioned on the thermal print head 12 determines the corresponding number of pixels X1 of each line image printed on the photo paper 16. Moreover, the color concentration, that is, the gray level of each pixel X1 printed on the photo paper 16 is determined by the corresponding heater 22, which has a specific duration of each heating operation, and the total number of heating cycles.

Please refer to FIG. 3 and FIG. 4. FIG. 3 is a diagram of gray levels and a corresponding driving signal 30 according to the photo printer 10 shown in FIG. 1. FIG. 4 is a diagram of a binary data sequence of the driving signal 30 shown in FIG. 3. As shown in FIG. 3 and FIG. 4, before the thermal print head 12 of the photo printer 10 starts printing images onto the photo paper 16, all of the heaters 22 positioned on the thermal print head 12 are activated for a predetermined period Tp. In this way, each heater 22 will approach a predetermined printing temperature before printing. The above-mentioned procedure is called a preheating operation. In addition, the driving signal having a pulse with a binary value "1" activates the corresponding heater 22, and the driving signal corresponding to a binary value "0" deactivates the heater 22. Next, the photo printer 10 continuously activates the same heater 22 according to the corresponding gray level of the pixel X1. In other words, each heater 22 positioned on the thermal print head 12 is activated repeatedly according to the desired gray level of the corresponding pixel. The overall heating operation of the heater 22 is represented by a driving signal 30 and its corresponding binary values. The duration Tu of a pulse 32 is the heating time unit for activating the heater 22.

The heater 22 of the photo printer 10 can produce 256 (0~255) gray levels to print the corresponding pixel X1 with an appropriate gray level. A gray level corresponding to a lightest color concentration is equal to 0, and a gray level corresponding to a darkest color concentration is equal to 255. In other words, when the pixel X1 acquires a corresponding gray level equaling N, which is an integer between 0 and 255, the corresponding heater 22 is successively activated N times. Therefore, N pulses 32 of the driving signal 30 are repeatedly generated. That is, N binary "1" values are input to the heater 22 continuously. Please note that the photo paper 16 is printed one line at a time. Because each pixel X1 positioned on the same line may have different gray levels, each heater 22 has to wait for 255 durations Tu so that the thermal print head 12 can then print the next line image. That is, a first heater 22 could finish printing a corresponding pixel X1 with a smaller gray level within a short time. However, another heater 22 printing a corresponding pixel X1 with a greater gray level may take a longer time. The actual heating durations are therefore centralized in the early period of the total heating duration. The more continuous printing durations, the more the heat accumulation. Additionally, the heat accumulation effect causes the system temperature to increase and the next printing gray level will stray from the predetermined gray level thereby affecting the printing quality. For example when the pixel X1 acquires a corresponding gray level equaling 64, the corresponding heater 22 has to be successively activated 64 times. Therefore, 64 pulses 32 of the driving signal 30 are repeatedly generated. That is, 64 binary "1" values are input to the heater 22 continuously. In actuality, the heat accumulation effect usually makes the corresponding gray level greater than 64 and results in printing distortion.

SUMMARY OF INVENTION

It is therefore a primary objective of the present invention to provide a method of increasing thermal printer quality when printing a pixel at a gray level x on paper by a printer to solve the problems mentioned above.

Briefly summarized, a printing method is disclosed for printing a pixel at a gray level x on paper by a printer. The printer comprises a thermal print head, which comprises a heater for heating a ribbon to print pixels from a gray level 1 to m−1 on the paper. The method comprises: if x is not greater than a value n, heating the ribbon x times and evenly distributing the heating initiation times of the x times between the time point 0 and the time point (m*(x−1)/n) for printing the pixel at the gray level x on paper. If x is greater than a value n, the ribbon is heated x times and the heating initiation times of the n times are evenly distributed between the time point 0 and the time point (m*(n−1)/n) and the heating initiation times of the x−n times is evenly distributed after the heating initiation time points of the n times.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
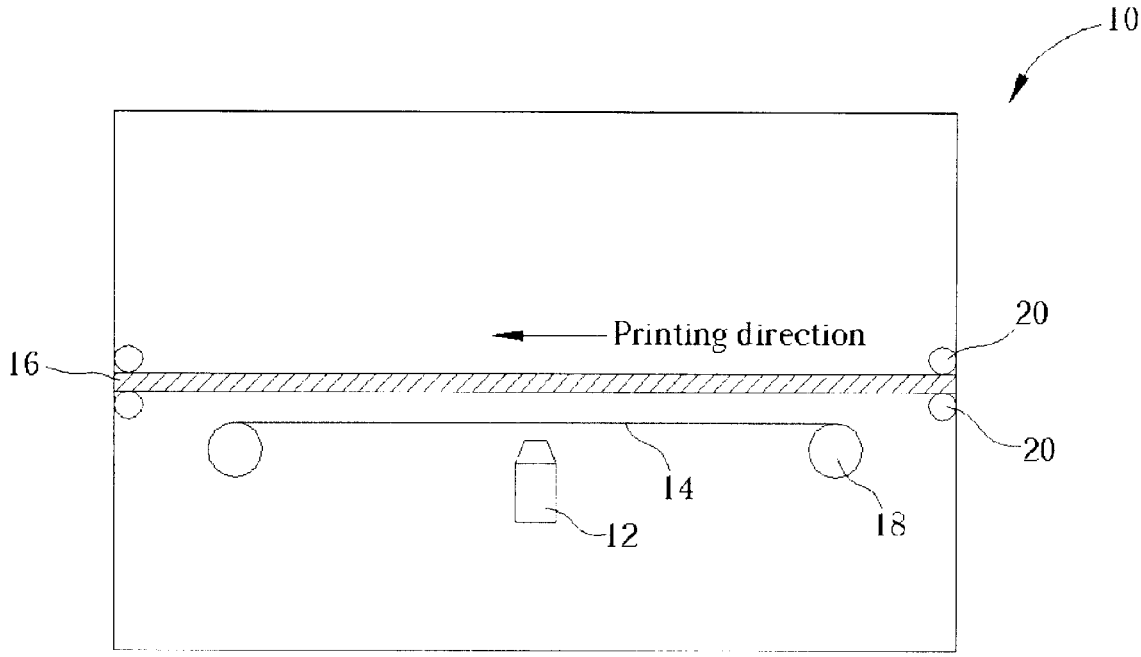
Fig. 1 Prior Art
FIG. 1 is a diagram of a prior art photo printer.
Figure 2:
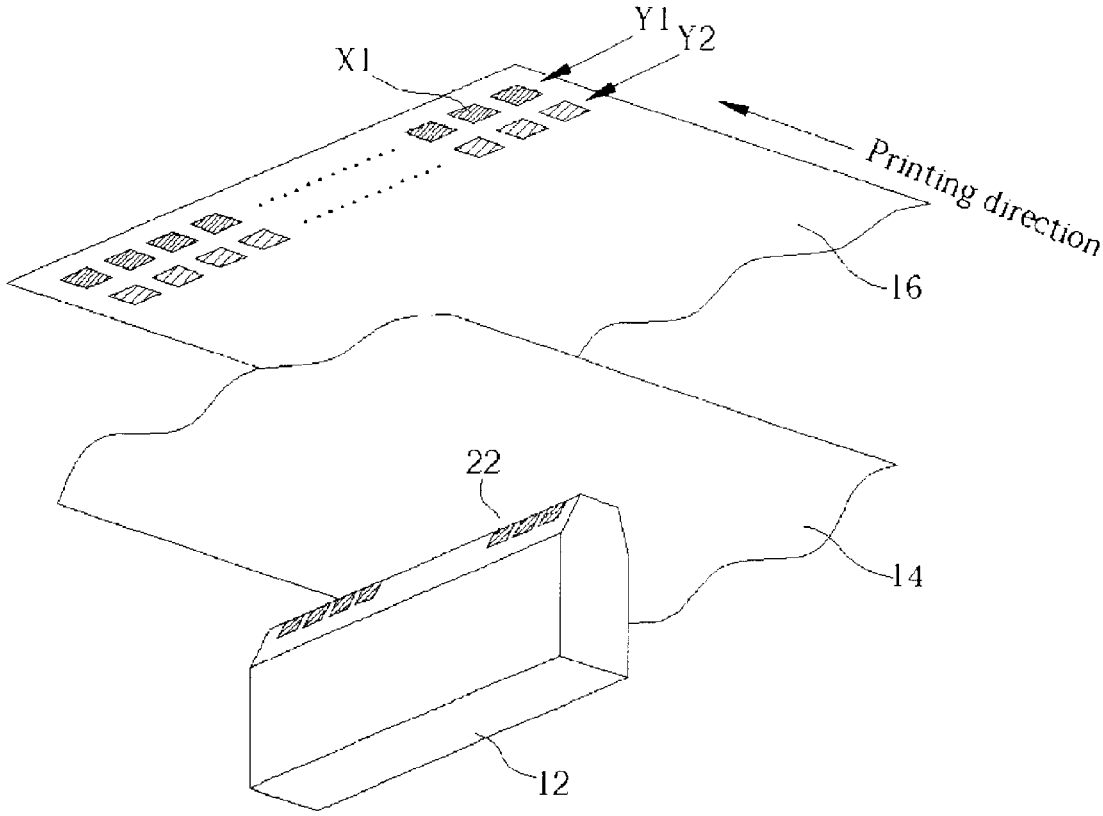
Fig. 2 Prior Art
FIG. 2 is a simplified exploded view of the photo printer—shown in FIG. 1.
Figure 3:
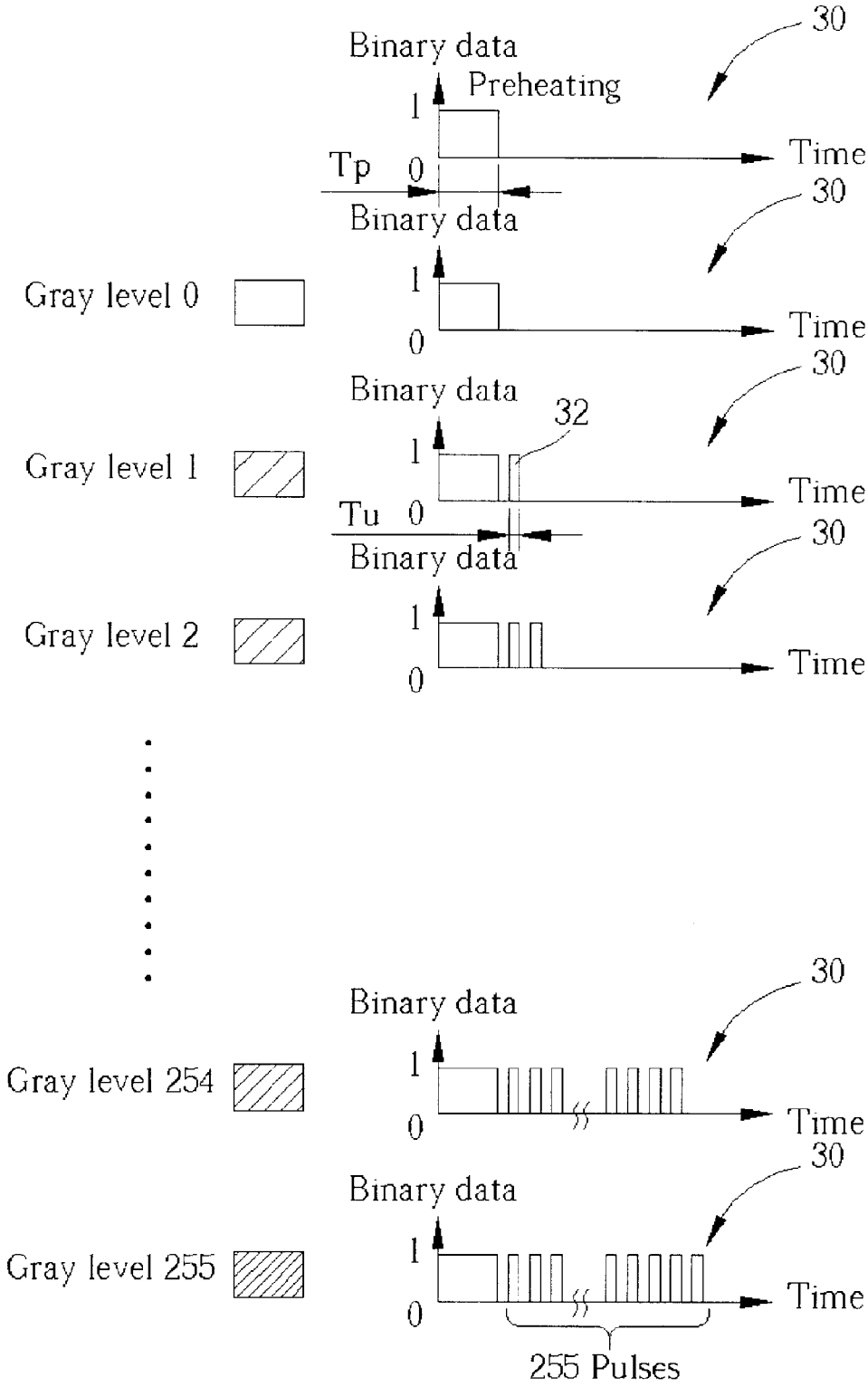
Fig. 3 Prior Art
FIG. 3 is a diagram of gray levels and a corresponding driving signal according to the photo printer shown in FIG. 1.
Figure 4:
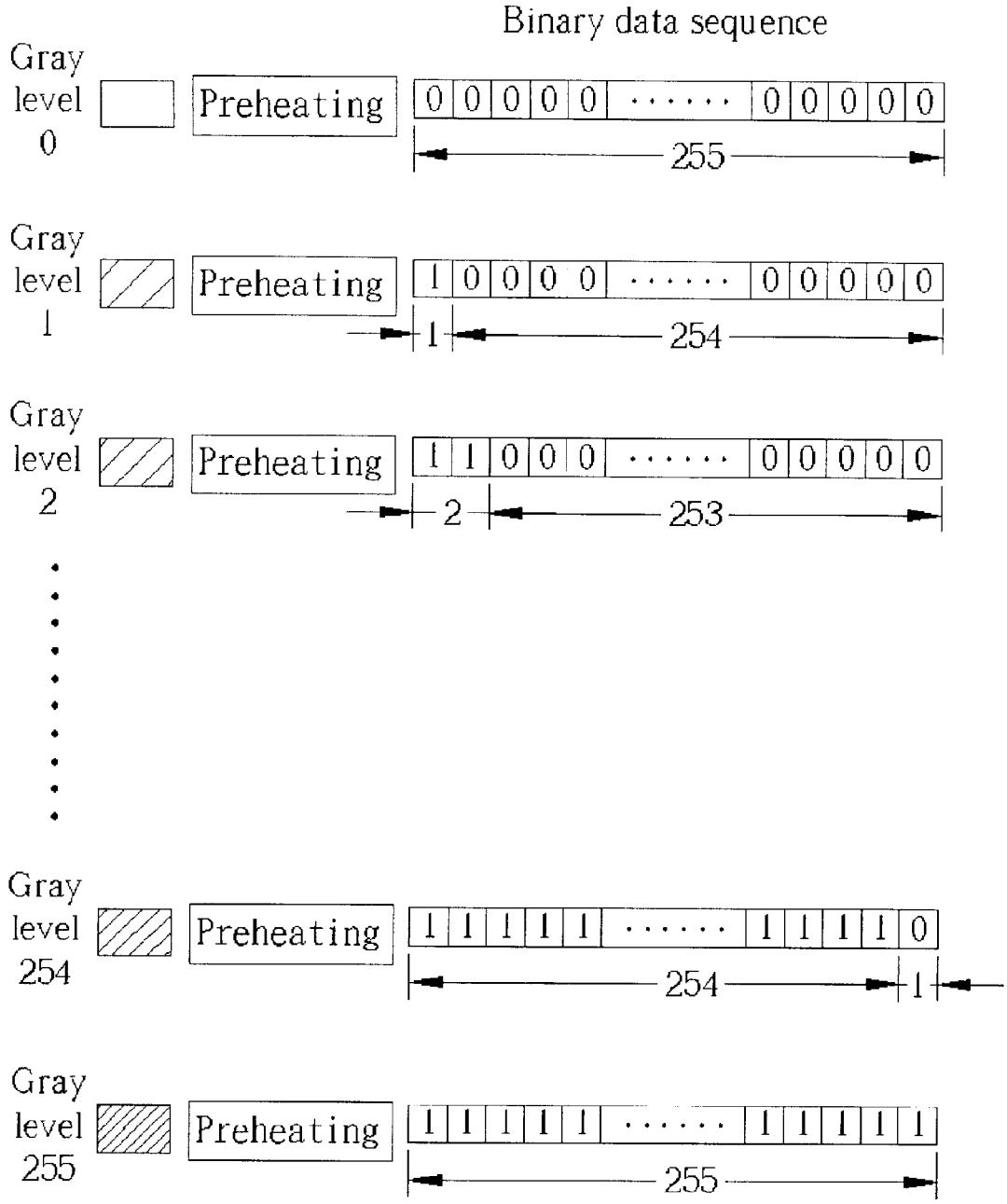
Fig. 4 Prior Art
FIG. 4 is a diagram of a binary data sequence of the driving signal shown in FIG. 3.
Figure 5:
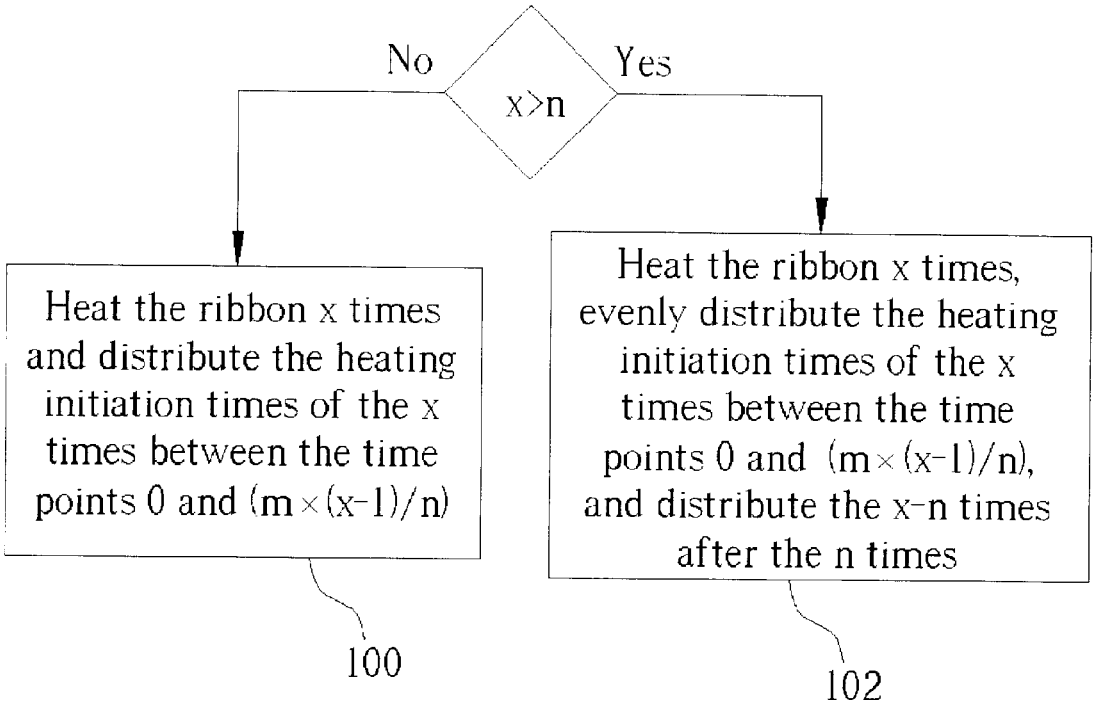
FIG. 5 is a flowchart illustrating a method for printing a pixel at gray level x on paper by a printer according to the present invention.

Please refer to FIG. 1, FIG. 2, and FIG. 5. FIG. 5 is a flowchart illustrating a method for printing a pixel at a gray level x on paper by the photo printer 10 according to the present invention. The photo printer 10 includes the thermal printer head 12 and the ribbon 14. The thermal print head 12 has the plurality of heaters 22 that are arranged linearly and spaced equally for heating the ribbon 14. The color dye stored in the ribbon 14 is heated, and is transferred onto the photo paper 16 for printing pixels of gray level 1 to m−1. The scanner according to the present invention can be a thermal printer or a photo printer. The structure of the thermal printer head 12 and the paper loading method of the photo printer 10 according to the present invention is the same as the prior art so the detailed description is omitted. The method of the present invention includes:

Step 100: If x is not greater than a value n, heat the ribbon 14 x times and evenly distribute the heating initiation times of the x times between the time point 0 and the time point (m*(x−1)/n), for printing the pixel at the gray level x on the photo paper 16.

Step 102: If x is greater than the value n, heat the ribbon 14 x times, evenly distribute the heating initiation times of the n times between the time point 0 and the time point (m*(n−1)/n), and distribute the heating initiation times of the x−n times after the heating initiation time points of the n times.

Figure 6:
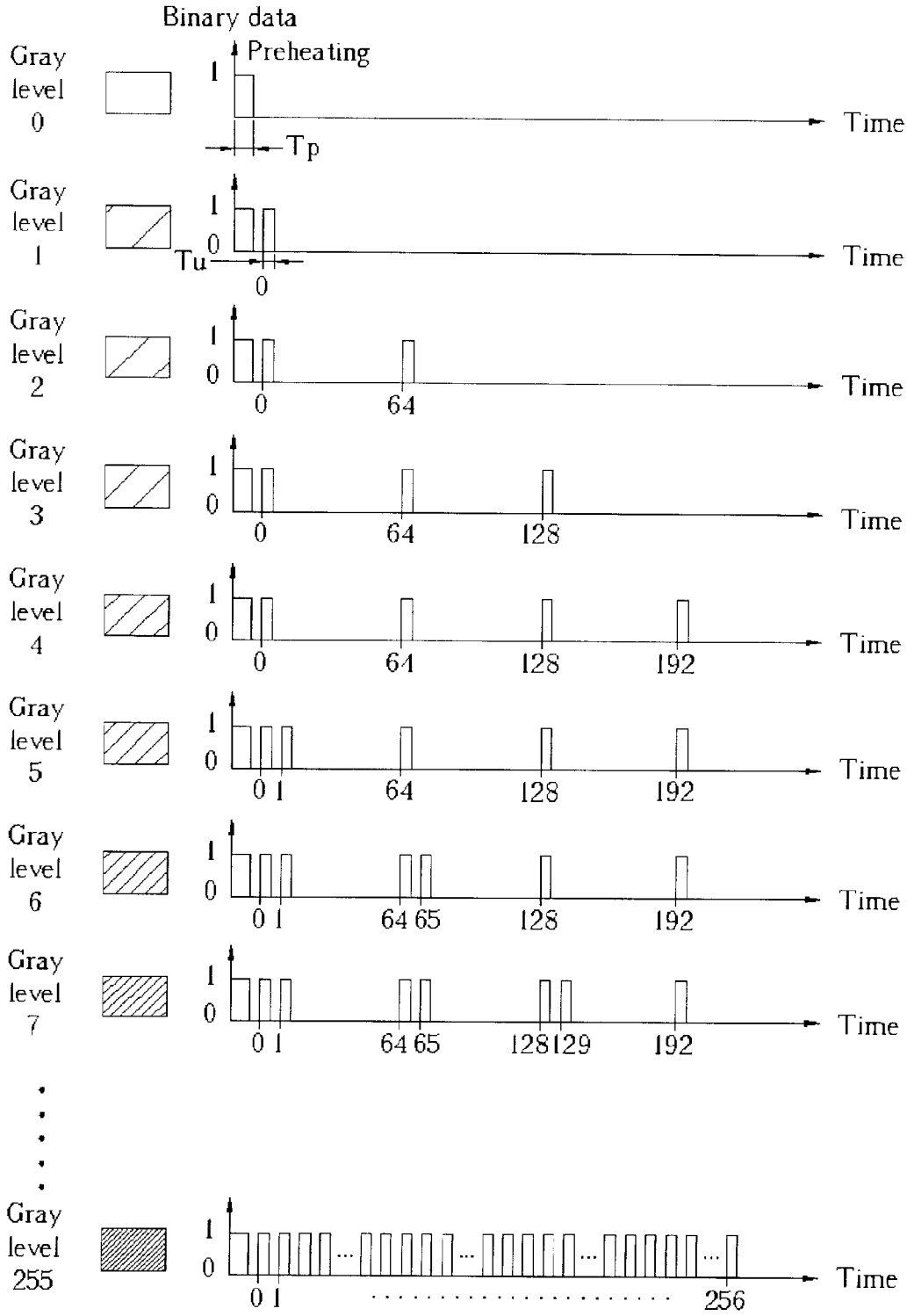
FIG. 6 is a diagram of gray levels and the corresponding driving signal when m is equal to 256 and n is equal to 4.
Figure 7:
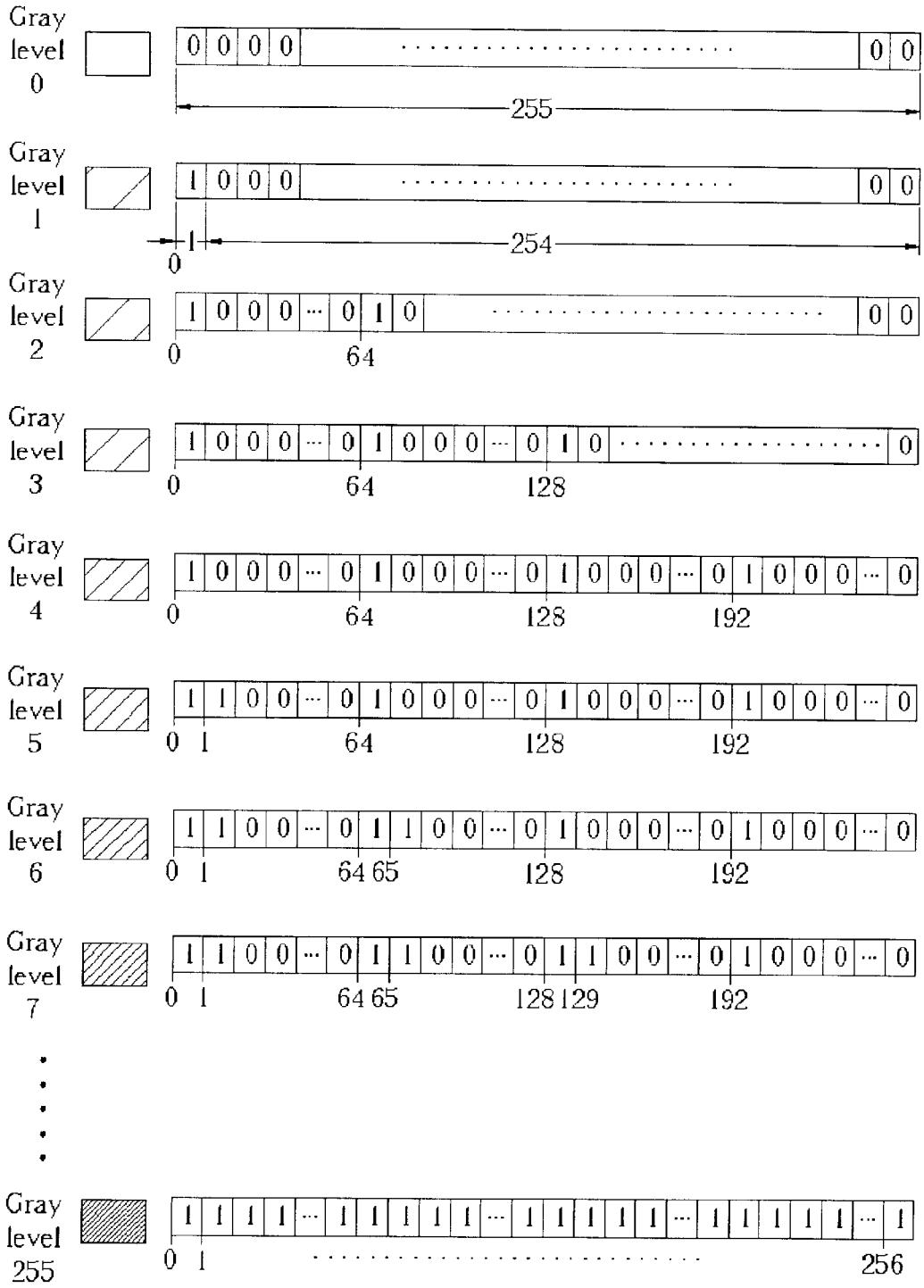
FIG. 7 is a diagram of a binary data sequence of the driving signal shown in FIG. 6.

For example when m is equal to 256, pixels at the gray levels 1 to 255 can be printed on the photo paper 16, and when n is equal to 4, 255 heating durations are divided into four periods and the heating initiation times are distributed to these four periods. Please refer to FIG. 6 and FIG. 7. FIG. 6 is a diagram of gray levels and a corresponding driving signal when m is equal to 256 and n is equal to 4. FIG. 7 is a diagram of a binary data sequence of the driving signal shown in FIG. 6. As shown in FIG. 6 and FIG. 7, before the thermal print head 12 of the photo printer 10 starts printing images onto the photo paper 16, all of the heaters 22 positioned on the thermal print head 12 are activated for a predetermined period Tp so that each heater 22 will first approach a predetermined printing temperature. The above-mentioned procedure is called the preheating operation. In addition, the driving signal having a pulse with a binary value "1" activates the corresponding heater 22, and the driving signal corresponding to a binary value "0" deactivates the heater 22. The photo printer 10 continuously activates the same heater 22 according to the corresponding gray level of the pixel. In other words, each heater 22 positioned on the thermal print head 12 is activated repeatedly according to the desired gray level of the corresponding pixel. The overall heating operation of the heater 22 is represented by the driving signal 30 and its corresponding binary values. The duration Tu of a pulse 32 is the heating time unit for activating the heater 22. The more heating time of the ribbon 14, the greater the gray level of the pixel printed by the heater 22 on the photo paper 16.

When m is equal to 256, pixels at gray levels 1 to 255 can be printed on the photo paper 16. A lightest color concentration is equal to 0 and a darkest color concentration is equal to 255. As shown in FIG. 6, when the pixel acquires a gray level equaling 0, the corresponding heater 22 is not activated after the preheating operation. When the pixel acquires a gray level equaling 1, the corresponding heater 22 is activated one time for a duration Tu after the preheating operation, and the heating initiation time is at time point 0. When the pixel acquires a gray level equaling 2, the corresponding heater 22 is activated two times for durations Tu individually after the preheating operation, and the heating initiation times are at time points 0 and 64 (256*(2-1)/4). When the pixel acquires a gray level equaling 3, the corresponding heater 22 is activated three times for durations Tu individually after the preheating operation, and the heating initiation times are at time points 0, 64 (256*(2-1)/4), and 128 (256*(3-1)/4). When the pixel acquires a gray level equaling 4, the corresponding heater 22 is activated four times for durations Tu individually after the preheating operation, and the heating initiation times are at time points 0, 64 (256*(2-1)/4), 128 (256*(3-1)/4), and 192 (256*(4-1)/4). That is to say, if x is not greater than the value n=4, the ribbon 14 is heated x times and the heating initiation times of the x times are evenly distributed between the time point 0 and the time point (256*(x−1)/4) for printing the pixel of the gray level x on the photo paper 16 instead of centralizing the heating initiation times in the early periods of the overall heating durations.

As shown in FIG. 6 and FIG. 7, when x is greater than the value n=4, for example when the pixel acquires a gray level equaling 5, the corresponding heater 22 is activated five times for durations Tu individually after the preheating operation, and the heating initiation times are at time points 0, 64 (256*(2-1)/4), 128 (256*(3-1)/4), 192 (256*(4-1)/4), and the time point 1 which is just behind the time point 0. That is, the sequence of the heating initiation times is 0, 1, 64, 128, 192; and each heating duration is Tu. When the pixel acquires a gray level equaling 6, the corresponding heater 22 is activated six times for durations Tu individually after the preheating operation, and the heating initiation times are at time points 0, 64 (256*(2-1)/4), 128 (256*(3-1)/4), 192 (256*(4-1)/4), the time point 1, which is just behind the time point 0, and the time point 65, which is just behind the time point 64. That is, the sequence of the heating initiation times is 0, 1, 64, 65, 128, 192; and each heating duration is Tu. When the pixel acquires a gray level equaling 7, the corresponding heater 22 is activated seven times for durations Tu individually after the preheating operation and the heating initiation times are at time points 0, 64 (256*(2-1)/4), 128 (256*(3-1)/4), 192 (256*(4-1)/4), the time point 1, which is just behind the time point 0, the time point 65, which is just behind the time point 64, and the time point 129, which is just behind the time point 128. That is, the sequence of the heating initiation times is 0, 1, 64, 65, 128, 129, 192; and each heating duration is Tu. That is to say, if x is greater than the value 4, the ribbon 14 is heated x times wherein the heating initiation times of 4 times are evenly distributed between the time point 0 and the time point (256*(4-1)/4), and the heating initiation times of the x−4 times are distributed behind the time points of the heating initiation times of the first 4 times. For example, when the pixel acquires a gray level equaling 24, the corresponding heater 22 is activated twenty-four times for durations Tu individually after the preheating operation, and the heating initiation times are at time points 0, 64 (256*(2-1)/4), 128 (256*(3-1)/4), 192 (256*(4-1)/4); which are the same as for gray level 4. The remaining twenty times are evenly distributed behind the above-mentioned four time points, such as the time points 0~5, 64~69, 128~133, and 192~197; and each heating duration is Tu. When the pixel acquires a gray level equaling 255, the corresponding heater 22 is activated 255 times for durations Tu individually after the preheating operation so that the heating initiation times are at time points 0~255 and each heating duration is Tu. In step 102, the heating initiation times of x−n times can be evenly distributed behind the time point of the heating initiation time of the n times as mentioned above; they also can be arranged by other methods.

The above-mentioned method is one of the embodiments of the invention and the value n and m are not limited to 4 and 256 respectively. The value m, which stands for the gray level range and the heating durations, and the value n, which stands for the division number of the heating durations, can be set according to design requirements. Additionally, the method for distributing the heating initiation times is not limited to an evenly distributed time sequence. The method of jumping in time sequence for different printing effects can be applied in the present invention. For example, when the pixel acquires a gray level equaling 1, the corresponding heater 22 is activated one time for duration Tu after the preheating operation, and the heating initiation time is on the time point 64 instead of the time point 0. The emphasis of the present invention is to distribute the heating Initiation times instead of centralizing the heating initiation times in the conventional technique. Therefore, all the distributing methods of the heating initiation times are covered by the present invention.

The transferring relation between the gray level and the heating initiation times is shown as FIG. 7. The gray level and the corresponding heating initiation times can be derived from a mathematical function or a table built using a diagram of a binary data sequence such as FIG. 7. The mathematical function and the table are dependent on the system, the heat printer head, the printing media, the color resolution, and the printing speed.

The heating durations Tu of the pulses 32 can all be the same or not. If the heating durations Tu are not all the same, the printer will produce different gray levels from the ones mentioned above because of the different heating periods. Basically, the longer heating period, the darker the gray level. The gray level is therefore not only related to the number of heating times, but also to the period of each heating pulse.

In contrast to the prior art, the characteristic of the present invention is distributing the heating initiation times into the total heating sequence instead of centralizing the heating initiation times in the early period of the overall heating durations. Centralizing the heating initiation times results in the increase of the system temperature and inaccurate gray level when printing the predetermined gray level due to the heat accumulation. Hence the present invention effectively improves the printing quality and avoids printing distortion due to heat accumulation.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A printing method for printing a pixel having a gray level of x on paper with a printer, the printer comprising a thermal print head and a ribbon, wherein the thermal print head comprises a heater for heating the ribbon to print pixels from gray levels 1 to m−1 on the paper, wherein m is a positive integer representing possible gray levels, x is the gray level of the pixel being printed, and a value n represents a predetermined number of heating duration divisions, x being a positive integer between 1 and m−1, inclusively, and n being a positive integer, the method comprising:

if x is not greater than the value n, heating the ribbon x times and evenly distributing the heating initiation times of the x times between the time point 0 and the time point (m*(x−1)/n), for printing the pixel with a gray level of x on the paper; and if x is greater than the value n, heating the ribbon x times and evenly distributing the heating initiation times of the first n times between the time point 0 and the time point (m*(n−1)/n) and distributing the heating initiation times of the remaining x−n times after the heating initiation time points of the first n times.

2. The method of claim 1, wherein if x is greater than the value n, the heating initiation times of the remaining x−n times are distributed after the heating initiation time points of the first n times in order.

3. The method of claim 1, wherein the more times the ribbon is heated, the darker the gray level of the pixel printed by the heater on the paper is.

4. The method of claim 1, wherein m is equal to 256.

5. The method of claim 4, wherein n is equal to 4.

6. The method of claim 1, wherein the printer is a thermal printer.

7. The method of claim 1, wherein the printer is a photo printer.

* * * * *